US009567718B2

(12) United States Patent
Faraci et al.

(10) Patent No.: US 9,567,718 B2
(45) Date of Patent: Feb. 14, 2017

(54) ADJUSTABLE SNOW SHOVEL SYSTEM

(71) Applicants: Joseph Faraci, Arlington Heights, IL (US); Frank Faraci, Arlington Heights, IL (US); Peter Masi, Schaumburg, IL (US)

(72) Inventors: Joseph Faraci, Arlington Heights, IL (US); Frank Faraci, Arlington Heights, IL (US); Peter Masi, Schaumburg, IL (US)

( * ) Notice: Subject to any disclaimer, the term of this patent is extended or adjusted under 35 U.S.C. 154(b) by 0 days.

(21) Appl. No.: 15/087,865

(22) Filed: Mar. 31, 2016

(65) Prior Publication Data

US 2016/0215466 A1 Jul. 28, 2016

Related U.S. Application Data

(63) Continuation-in-part of application No. 14/253,661, filed on Apr. 15, 2014, now abandoned, which is a continuation-in-part of application No. 13/542,949, filed on Jul. 6, 2012, now Pat. No. 8,800,175.

(51) Int. Cl.
*E01H 5/02* (2006.01)
*E01H 5/06* (2006.01)

(52) U.S. Cl.
CPC ..... *E01H 5/061* (2013.01); *E01H 5/02* (2013.01)

(58) Field of Classification Search
CPC ..... E01H 5/02; E01H 5/06; E01H 5/061; E01H 5/065; E01H 5/066; E01H 5/067; B25G 1/102
USPC ..... 37/273, 278, 285, 284
See application file for complete search history.

(56) References Cited

U.S. PATENT DOCUMENTS 96,205 A * 10/1869 Cravath et al. ..... E01H 8/04 37/217
157,078 A * 11/1874 Parker et al. ..... E01H 5/02 37/274
323,656 A * 8/1885 Franz ..... E01H 5/067 37/274
469,682 A * 3/1892 Denham ..... E01H 8/04 37/217
533,036 A * 1/1895 Cox ..... E01H 8/04 37/217
731,419 A * 6/1903 Wykoff ..... E01H 5/06 37/273
801,090 A * 10/1905 Kenney ..... E01H 5/02 37/277

(Continued)

FOREIGN PATENT DOCUMENTS

AT 222164 B * 7/1962 ..... E01H 5/02
CA 2436616 A1 * 2/2005 ..... E01H 5/06

(Continued)

*Primary Examiner* — Robert Pezzuto
*Assistant Examiner* — Joan D Misa

(57) ABSTRACT

An adjustable snow shovel system for facilitating effective removal of snow that has an ergonomically optimized handle for steering. The system has a blade-angle adjustment mechanism for extending and retracting shovel blades as appropriate for shovelling snow. The blade-angle adjustment mechanism is protected by a nose piece that also assists with removing snow. The system has a truck assembly that allows the system's wheels to swivel 360 degrees for fluid steering. The entire truck assembly can also swivel 180 degrees, allowing for easy storage of the system.

10 Claims, 6 Drawing Sheets

(56) References Cited

U.S. PATENT DOCUMENTS 803,820 A * 11/1905 Grimes ..... E01H 5/065 172/291
830,871 A * 9/1906 Wilken ..... E01H 5/06 172/358
885,309 A 4/1908 Adams
964,158 A * 7/1910 Grimes ..... E01H 5/065 37/269
1,079,369 A * 11/1913 Sims ..... E01H 5/06 37/271
1,276,672 A * 8/1918 Mason, Jr. ..... E01H 5/06 37/273
1,284,562 A * 11/1918 Beck ..... E01H 5/06 37/273
1,307,410 A * 6/1919 Morris ..... E01H 5/06 172/736
1,319,972 A * 10/1919 Shun ..... E01H 5/06 37/273
1,375,505 A 4/1921 Grady
1,415,979 A * 5/1922 Bedford ..... E01H 5/02 172/358
1,508,786 A * 9/1924 Grimes ..... E01H 5/066 37/271
1,517,016 A * 11/1924 Relien ..... E01H 5/06 37/271
1,544,983 A * 7/1925 Heinzen ..... E01H 5/066 37/274
1,550,574 A * 8/1925 Sargent ..... E01H 5/067 37/271
1,550,575 A * 8/1925 Sargent ..... E01H 5/067 37/234
1,697,572 A 1/1929 Perham
1,820,692 A * 8/1931 Cooper ..... E01H 5/02 37/274
1,956,295 A 4/1934 Lindgren
D123,113 S * 10/1940 Loud et al. ..... 16/437
2,388,985 A 11/1945 Martin
2,513,231 A * 6/1950 Bourne ..... E01H 5/066 172/676
2,536,607 A 1/1951 Jenkins
2,658,804 A 11/1953 Andrews
2,724,610 A 11/1955 Fitzgerald
2,752,840 A 7/1956 Schrader
2,767,545 A 10/1956 Jenkins
2,771,089 A 11/1956 Magida
2,803,071 A * 8/1957 Pochopien ..... E01H 5/02 37/283
2,811,792 A * 11/1957 Cork, Jr. ..... E01H 5/02 37/270
2,863,232 A * 12/1958 Steinbach ..... E01H 5/02 37/270
D190,820 S * 7/1961 O'Connor ..... 37/284
2,997,796 A * 8/1961 Pogue ..... E01C 19/202 222/625
3,023,021 A * 2/1962 Fricke ..... E01H 5/02 280/47.34
3,024,547 A * 3/1962 Harrison ..... B62B 1/20 280/47.26
3,431,661 A * 3/1969 Carlson ..... E01H 5/02 294/57
3,468,041 A * 9/1969 Mattson ..... E01H 5/04 37/246
3,475,838 A * 11/1969 Hagen ..... E01H 5/02 280/47.24
3,526,979 A * 9/1970 Ladewski ..... E01H 5/02 37/273
3,773,375 A 11/1973 Nehls
3,898,753 A 8/1975 Kinnunen
4,103,954 A 8/1978 Vaslas
4,159,584 A * 7/1979 Niemela ..... E01H 5/066 280/481
4,787,661 A 11/1988 Rutledge
4,804,219 A 2/1989 Berg
4,878,704 A 11/1989 Jacanin et al.
4,958,407 A * 9/1990 Johnson ..... A01B 1/22 15/144.1
4,991,324 A 2/1991 Fine et al.
5,048,883 A 9/1991 Waluk
5,133,582 A 7/1992 Rocha
5,197,772 A * 3/1993 Stecyk ..... E01H 5/02 294/54.5
5,228,734 A 7/1993 Pollastro
5,440,828 A 8/1995 Simpson
5,440,868 A 8/1995 Darnell
5,669,163 A * 9/1997 Winter ..... E01H 5/02 37/265
5,676,412 A 10/1997 Kahley
5,727,830 A 3/1998 Asher
5,782,518 A * 7/1998 Scruggs ..... A01B 1/02 15/143.1
5,791,072 A 8/1998 Schbot
5,810,408 A 9/1998 Armstrong
5,887,920 A * 3/1999 Perciful ..... A01B 1/02 294/57
6,269,558 B1 8/2001 Alexander
6,290,273 B1 9/2001 Moisan
6,592,160 B1 7/2003 Nicolay et al.
D543,424 S * 5/2007 Miller ..... D8/1
7,237,814 B2 7/2007 Handzlik
7,299,614 B2 11/2007 Sanders
7,681,336 B2 * 3/2010 Noonan ..... B62B 1/147 294/54.5
7,856,802 B2 12/2010 Thibault et al.
8,166,677 B1 5/2012 Woyak
8,240,069 B2 * 8/2012 Adinata ..... A61K 48/00 37/285
8,616,597 B2 * 12/2013 Guerra ..... A01B 1/026 294/57
8,800,175 B1 8/2014 Faraci
9,255,368 B1 * 2/2016 Doolittle ..... E01H 5/02
2002/0088148 A1 7/2002 Kagen
2005/0268498 A1 12/2005 Fortino
2007/0068050 A1 * 3/2007 Flanagan ..... E01H 5/02 37/285
2009/0013564 A1 * 1/2009 Mallaridas ..... E01H 5/02 37/273
2009/0184527 A1 * 7/2009 Marion ..... B25G 1/102 294/54.5
2011/0214316 A1 9/2011 Gomez
2011/0258888 A1 10/2011 Swenson
2013/0167413 A1 * 7/2013 Lewis ..... E01H 5/02 37/278
2015/0204038 A1 * 7/2015 Faraci ..... E01H 5/02 37/273
2015/0284929 A1 * 10/2015 Behan ..... E01H 5/061 172/371
2016/0128260 A1 * 5/2016 Adams ..... A01B 1/022 294/51

FOREIGN PATENT DOCUMENTS

DE 1166236 B * 3/1964 ..... E01H 5/02
GB 2499811 A * 9/2013 ..... E01H 5/02

* cited by examiner

ADJUSTABLE SNOW SHOVEL SYSTEM

CROSS REFERENCE

This application claims priority to U.S. Non-Provisional patent application Ser. No. 14/253,661, filed Apr. 15, 2014 as a continuation-in-part, and claims priority to U.S. Non-Provisional patent application Ser. No. 13/542,949 filed Jul. 6, 2012 now U.S. Pat. No. 8,800,175 issued Aug. 12, 2014, the specification(s) of which is/are incorporated herein in their entirety by reference.

BACKGROUND OF THE INVENTION

Snow shovels have been used for clearing snow accumulation for many years, likely since the advent of a standard shovel. A typical snow shovel is equipped with a generally flat blade constructed from plastic or aluminum with a centrally located handle attached. While generally effective, the snow shovel requires a significant physical effort for use leading to fatigue and sometimes pain for the user. The present invention features an adjustable snow shovel system for facilitating effective removal of accumulated snow.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
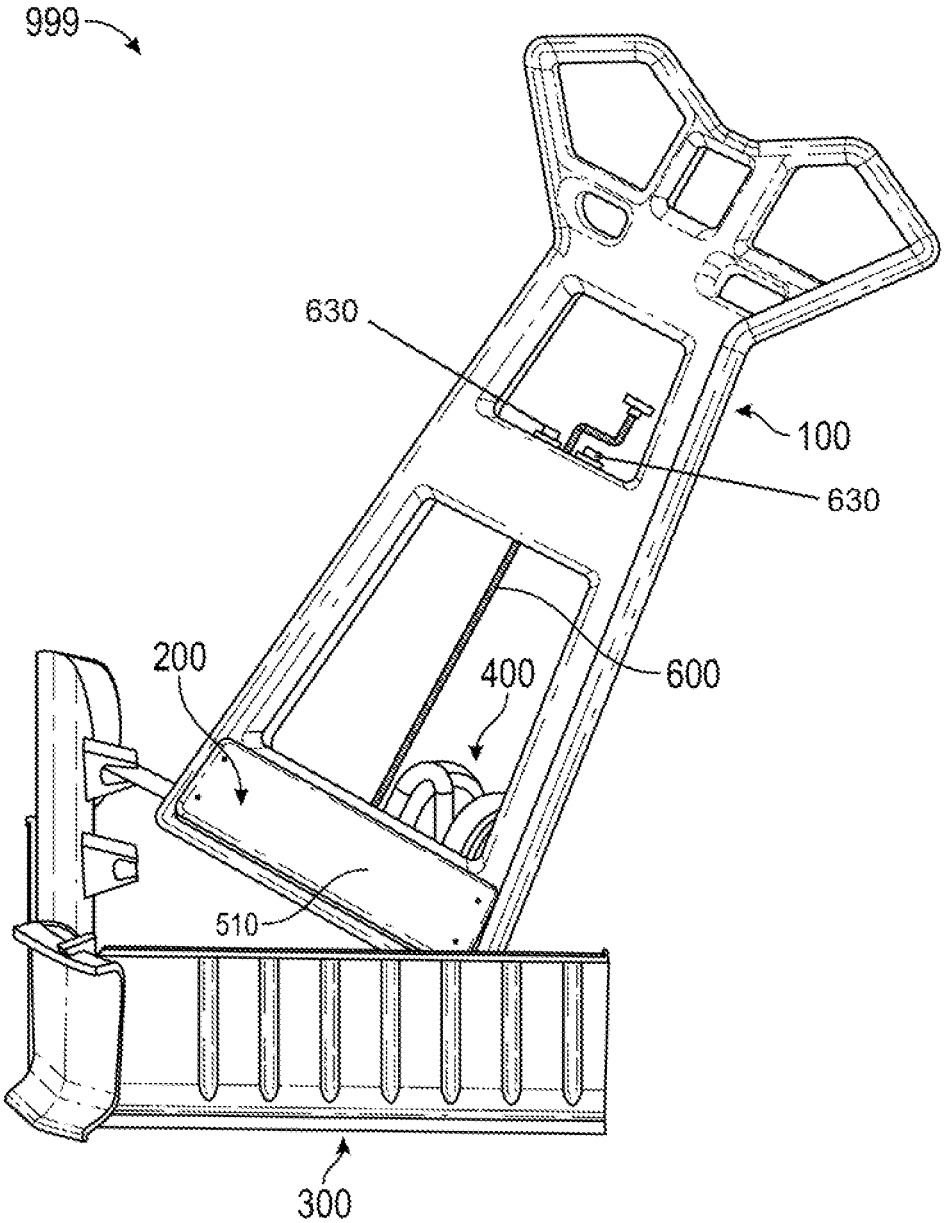
FIG. 1 shows the adjustable snow shovel system (999).

Following is a list of elements corresponding to a particular element referred to herein:

999 adjustable snow shovel system
100 rectangular-tubular frame
110 body section
111 body first side
112 body second side
113 body top end
114 body bottom end
115 first body support
116 second body support
120 handle section
121 handle first side
122 handle second side
123 handle top end
124 handle bottom end
125 rest surface

126 first handle bar
127 second handle bar
128 handle mid-piece
200 blade-angle adjustment mechanism
210 pair of racks
211 rack first end
212 rack second end
220 pinion
230 pair of arms
231 arm first end
232 arm second end
240 hinge hole
300 shovel blade assembly
310 pair of blades
320 blade arm hub
330 blade arm clip
340 blade top end
350 blade bottom end
360 hinge
370 V-shaped shovel nose
400 truck assembly
410 wheel support tube
411 tube first end
412 tube second end
420 spindle
430 pair of wheels
510 first body cover plate
520 second body cover plate
530 tube housing
600 angle adjustment shaft
610 shaft first end
620 shaft second end
630 pair of shaft clips Referring now to FIG. 1, the present invention is shown. The present invention is an adjustable snow shovel system (999).

Figure 2:
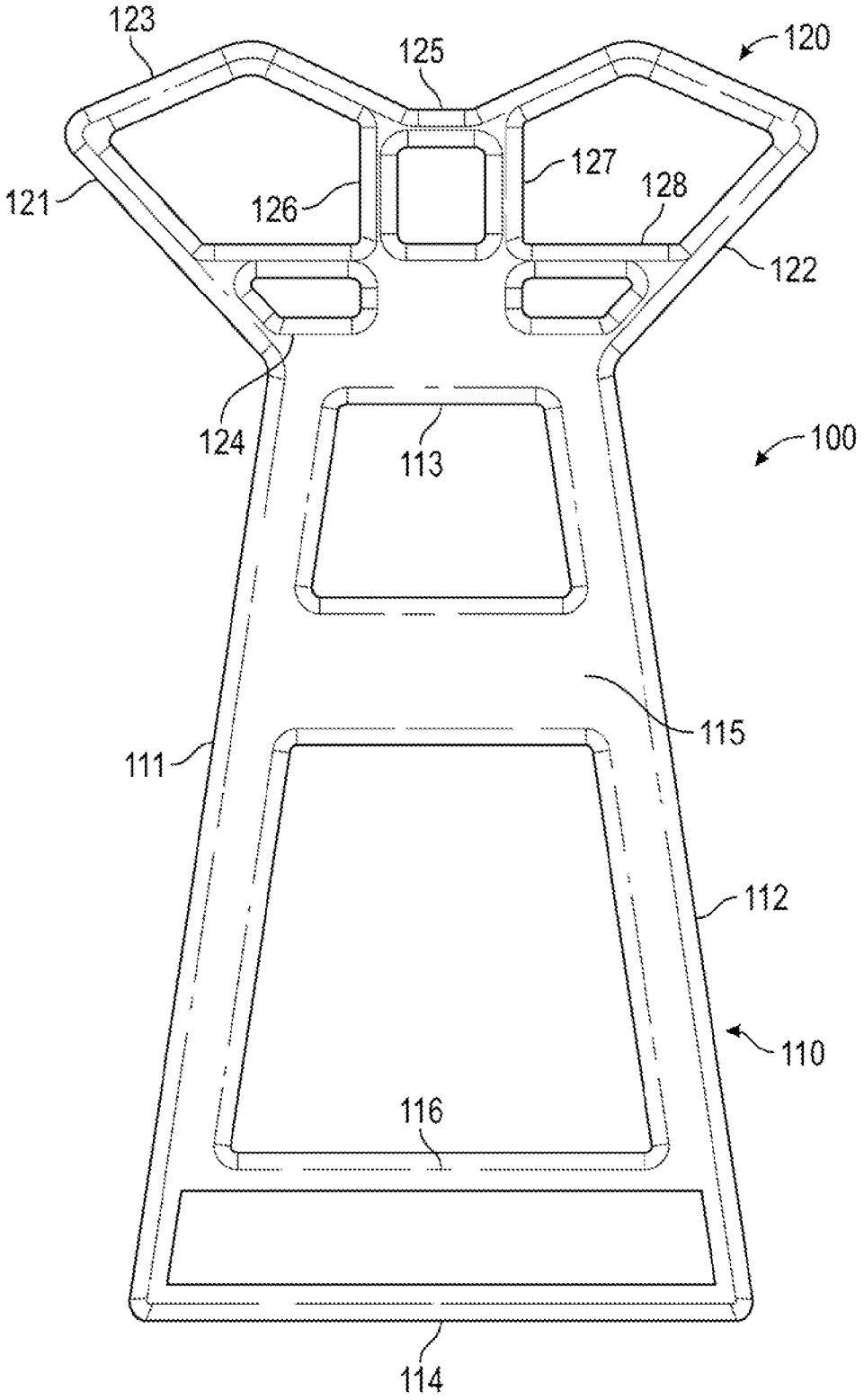
FIG. 2 shows the rectangular tubular frame (100).

In some embodiments, the system (999) comprises a rectangular-tubular frame (100) having a body section (110) and a handle section (120). Referring now to FIG. 2, the rectangular-tubular frame (100) is shown.

In some embodiments, the handle section (120) has a V-shaped outline, wherein the valley of the handle section (120) defines a rest surface (125) on which a user can lean against and thus push the system (999) with his or her body weight. It is believed that this allows the user to push the system (999) with greater ease. The handle section (120) comprises a handle first side (121), a handle second side (122), a handle top end (123), and a handle bottom end (124). In some embodiments, a handle mid-piece (128) is disposed from the handle first side (121) to the handle second side (122). In some embodiments, a first handle bar (126) and a second handle bar (127) are disposed 90 degrees to and through the handle mid-piece (128) from the handle bottom end (124) to the handle top end (123). In some embodiments, the first handle bar (126) and the second handle bar (127) are symmetrically offset from the center of the handle section (120). It is believed that the first handle bar (126), second handle bar (127), and handle mid-piece (128) provide different grip points for the user. This allows the proper amount of force to be applied to the system (999) for fluid steering. Without wishing to limit the present invention to any theory or mechanism, it is believed the handle section (120), especially the features mentioned above, is designed for optimal human ergonomics.

In some embodiments, the body section (110) has a trapezoidal-shaped outline. The body section (110) comprises a body first side (111), body second side (112), body top end (113), and a body bottom end (114). In some embodiments, a first body support (115) and a second body support (116) are disposed from the body first side (111) across to the body second side (112). This is believed to provide structural integrity to the body section (110).

Figure 3:
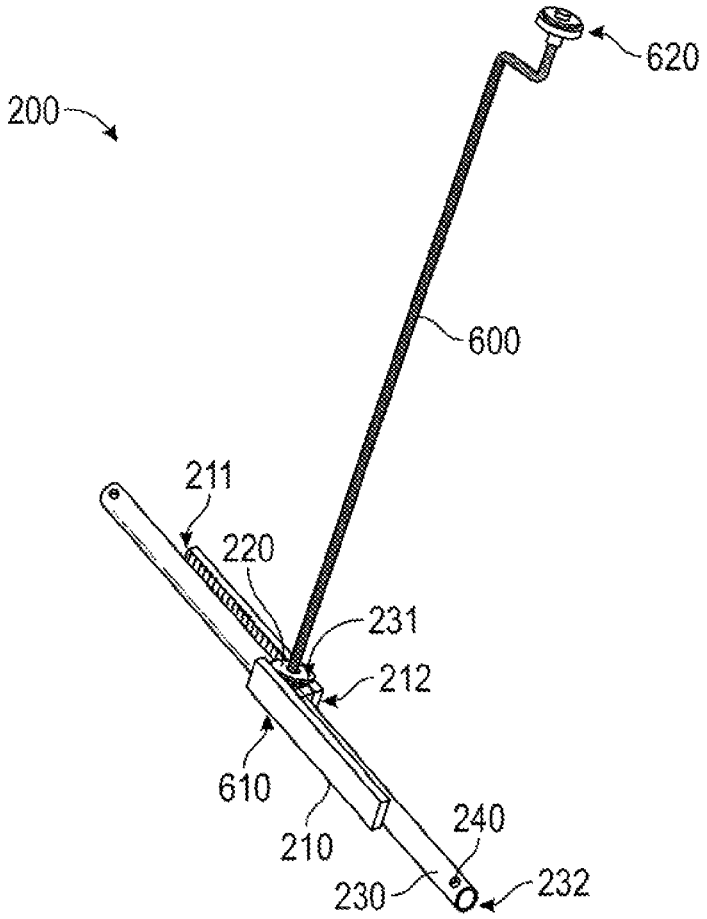
FIG. 3 shows the blade-angle adjustment mechanism (200).
Figure 4:
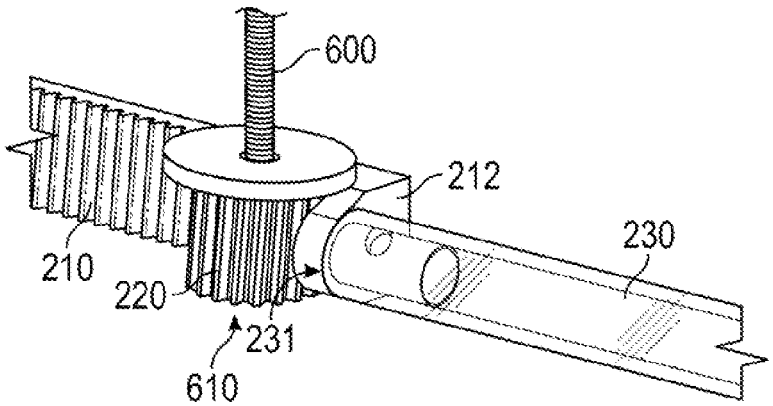
FIG. 4 shows a zoomed view of the blade-angle adjustment mechanism (200).

In some embodiments, the system (999) comprises a blade-angle adjustment mechanism (200). Referring now to FIG. 3 and FIG. 4, the blade-angle adjustment mechanism (200) is shown. In some embodiments, the mechanism (200) has a pair of racks (210) and a pinion (220). The pair of racks (210) each has a rack first end (211) and a rack second end (212). In some embodiments, the mechanism (200) also has a pair of arms (230) each comprising an arm first end (231) and an arm second end (232), wherein the arm second end (232) has a hinge hole (240). The arm first end (231) is disposed on the rack second end (212).

Figure 5:
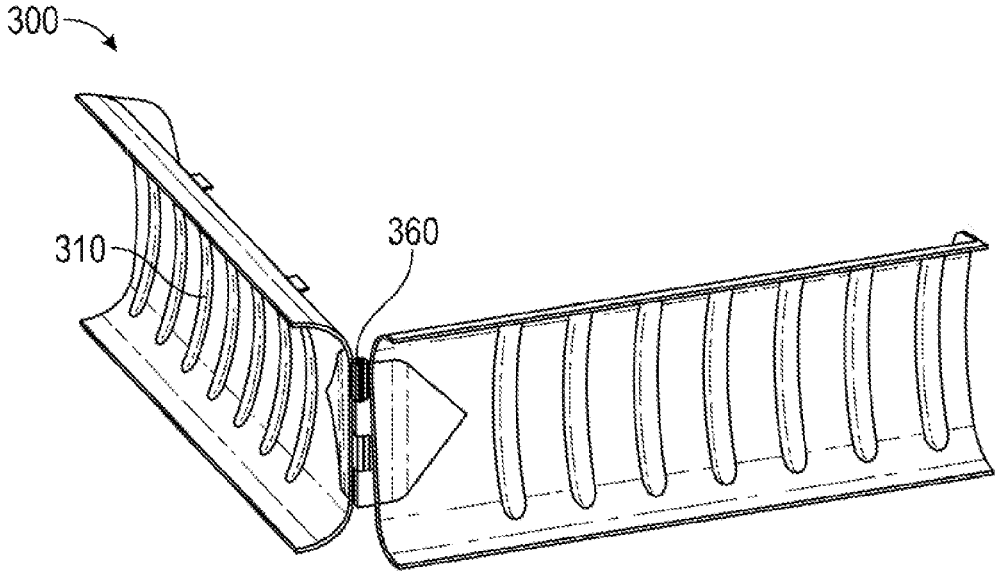
FIG. 5 shows the shovel blade assembly (300).
Figure 6:
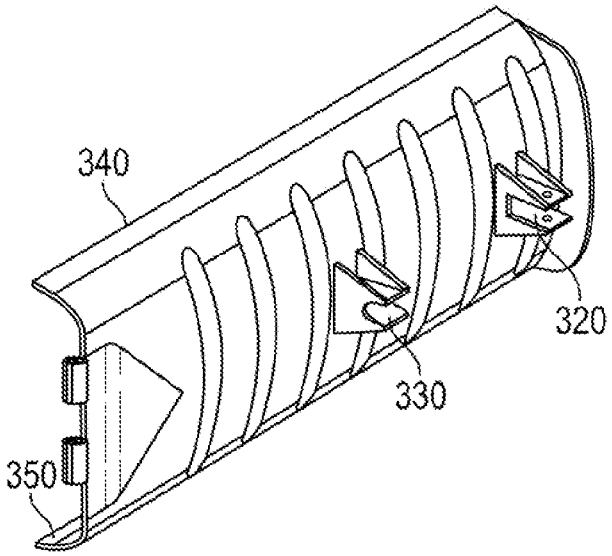
FIG. 6 shows a blade (310) of the shovel blade assembly (300).

In some embodiments, the system (999) comprises a shovel blade assembly (300). Referring now to FIG. 5 and FIG. 6, the shovel blade assembly (300) is shown. The shovel blade assembly (300) has a pair of blades (310), and in some embodiments, each blade (310) has a blade arm hub (320) and a blade arm clip (330). In some embodiments, each blade (310) has a blade top end (340) and a blade bottom end (350) both adapted to shovel snow. It is believed that this effectively doubles the availability of the system (999), since the pair of blades (310) can be flipped such that when the blade top end (340) dulls the blade bottom end (350) can continue to shovel snow, and vice versa. In some embodiments, the pair of blades (310) are pivotally connected via a hinge (360). In some embodiments, in order to prevent snow from impeding the system's (999) mobility and to protect the hinge (360), a V-shaped shovel nose (370) is disposed on the hinge, partially overlapping the pair of blades (310).

Figure 8:
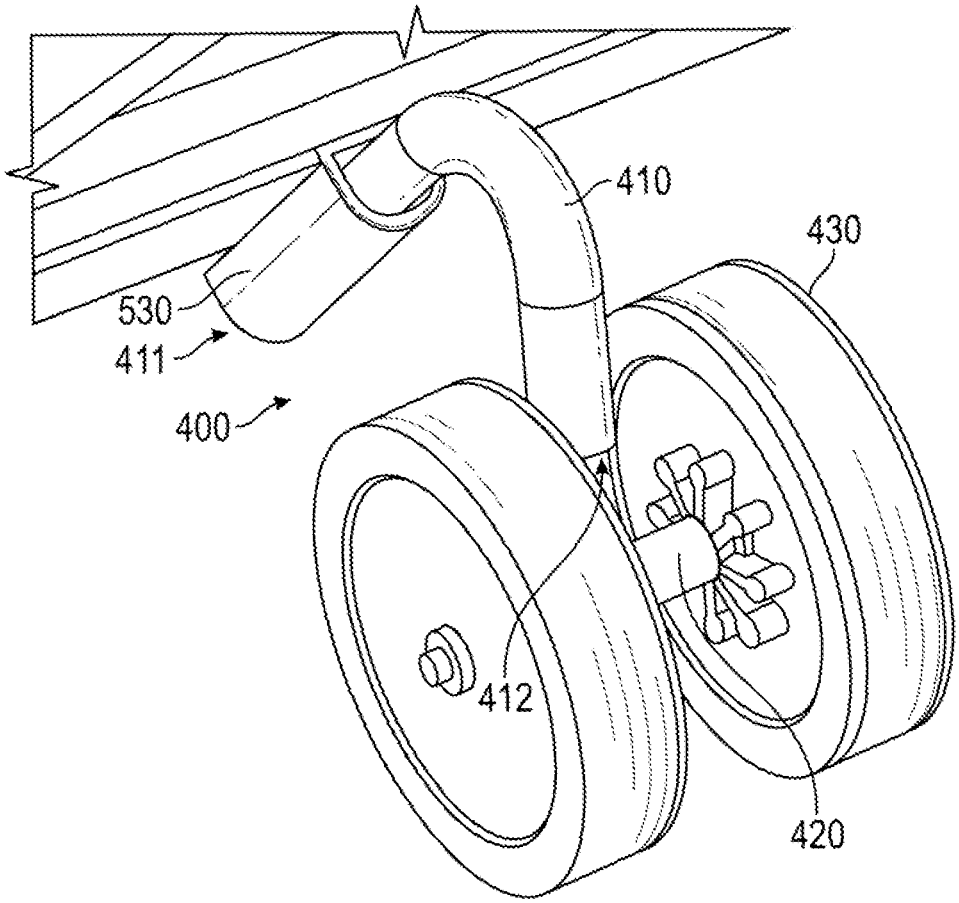
FIG. 8 shows the truck assembly (400).

In some embodiments, the system (999) comprises a truck assembly (400). Referring now to FIG. 8, the truck assembly (400) is shown. In some embodiments, the truck assembly (400) has a goose neck-shaped wheel support tube (410), a spindle (420), and a pair of wheels (430). The wheel support tube (410) comprises a tube first end (411) and a tube second end (412). In some embodiments, the spindle (420) is disposed on the tube second end (412) and the pair of wheels (430) are disposed on the spindle (420). In some embodiments, the pair of wheels (430) can swivel 360 degrees via the spindle (420) rotating about the tube second end (412). It is believed that this feature allows for mobility from the pair of wheels (430) and thus fluid navigation and steering of the system (999).

In a non-limiting example, the assembly of the system (999) is as follows: the body section (110) and handle section (120) are one whole component as the handle bottom end (124) is fluidly disposed on the handle top end (123). The blade-angle adjustment mechanism (200) is disposed in between the second body support (116) and the body bottom end (114), then sandwiched between a first body cover plate (510) and a second body cover plate (520), such that the first body cover plate (510) and second body cover plate (520) are disposed on the body section (110) from the second body support (116) to the body bottom end (114).

Continuing with the example assembly, the shovel blade assembly (300) is then pivotally connected to the blade-angle adjustment mechanism (200) via the blade arm hub (320) hinging to the hinge hole (240) on each of the pair of blades (310). When the pair of blades (310) are in-line with each other, the blade arm clip (330) secures the arm (230) to keep the blades sturdy.

Installation of an angle adjustment shaft (600) comprising a shaft first end (610) and a shaft second end (620) then follows. The shaft first end (610) is disposed through the first body support (115) and second body support (116) to key into the pinion (220). The shaft second end (620) is secured to the first body support (115) via a pair of shaft clips (630). To change the angle of the shovel blade assembly (300), the shaft second end (620) is first removed from the pair of shaft clips (630). The shaft second end (620) is then turned to activate the pinion (220) to extend or retract the pair of arms (230) disposed on the pair of racks (210), thus pivoting the pair of blades (310) and changing the angle of the shovel blade assembly (300). In some embodiments, the blade-angle adjustment mechanism (200) allows for more than six configurations of the system (999), The example assembly continues with a tube housing (530) centrally disposed on the second body cover plate (520). The tube first end (411) of the wheel support tube (410) inserts through and secures to the tube housing (530) such that the pair of wheels (430) contact the ground. The angle of the system (999) relative to the ground is adjustable via adjusting the extent to which the tube first end (411) is secured to the tube housing (530). In some embodiments, the tube first end (411) can be swiveled 180 degrees so that the pair of wheels (430) can be stored in between the first body support (115) and second body support (116). It is believed that this allows for easier storage of the whole system (999). For example, tucking the pair of wheels (430) in between the first body support (115) and second body support (116) allows the system (999) to be hung flush on a wall.

Figure 7:
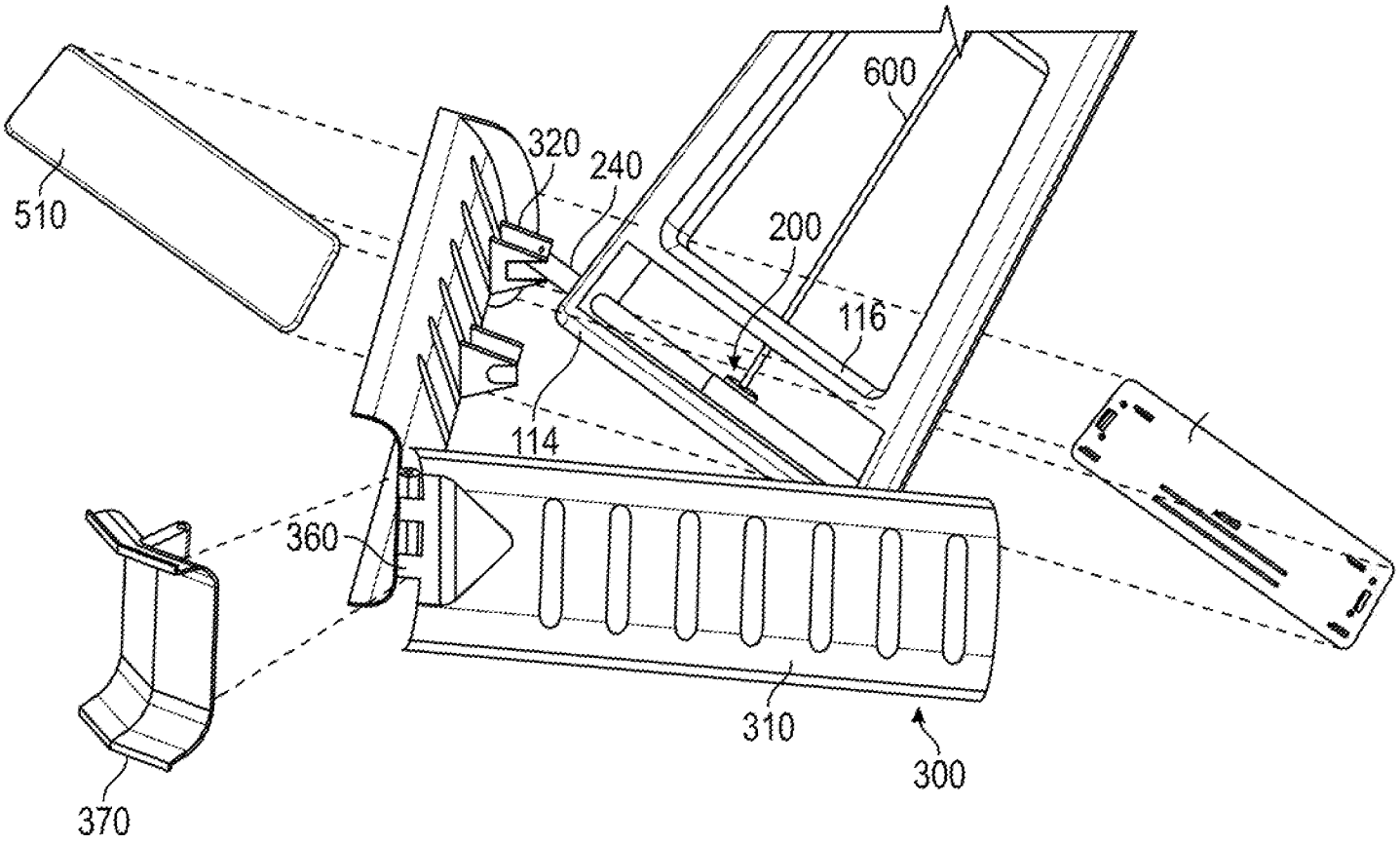
FIG. 7 shows a partially exploded view of the assembly of the system (999).

Referring now to FIG. 7, a partial assembly of the system (999) is shown.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An adjustable snow shovel system (999) for facilitating effective removal of snow, comprising:

a rectangular-tubular frame (100) having a body section (110) and a handle section (120), the handle section (120) having a V-shaped outline, wherein a valley of the handle section (120) defines a rest surface (125) on which users can push the system (999) with body weight, wherein the handle section (120) comprises a handle first side (121), a handle second side (122), a handle top end (123), and a handle bottom end (124), wherein a handle mid-piece (128) is disposed from the handle first side (121) to the handle second side (122), wherein a first handle bar (126) and a second handle bar (127) are disposed 90 degrees to and through the handle mid-piece (128) from the handle bottom end (124) to the handle top end (123), wherein the first handle bar (126) and the second handle bar (127) are symmetrically offset from the center of the handle section (120), wherein pushing the handle top end (123) with the first handle bar (126) or the second handle bar (127) allows for fluid steering of the system (999), the body section (110) having a trapezoidal-shaped outline, wherein the body section (110) comprises a body first side (111), body second side (112), body top end (113), and a body bottom end (114), wherein a first body support (115) and a second body support (116) are disposed from the body first side (111) across to the body second side (112), a blade-angle adjustment mechanism (200) having a pair of racks (210) and a pinion (220), wherein the pair of racks (210) each has a rack first end (211) and a rack second end (212), wherein a pair of arms (230) each comprises an arm first end (231) and an arm second end (232), wherein the arm second end (232) has a hinge hole (240), wherein the arm first end (231) is disposed on the rack second end (212), a shovel blade assembly (300) having a pair of blades (310), wherein each blade (310) has a blade arm hub (320) and a blade arm clip (330), wherein each blade (310) has a blade top end (340) and a blade bottom end (350) both adapted to shovel snow, wherein the pair of blades (310) are pivotally connected via a hinge (360), wherein a V-shaped shovel nose (370) covers and protects the hinge (360), wherein the shovel nose (370) prevents snow from impeding the system's (999) mobility, a truck assembly (400) having a goose neck-shaped wheel support tube (410), a spindle (420), and a pair of wheels (430), wherein the wheel support tube (410) comprises a tube first end (411) and a tube second end (412), wherein the spindle (420) is disposed on the tube second end (412), wherein the pair of wheels (430) are disposed on the spindle (420), wherein the pair of wheels (430) can swivel 360 degrees via the spindle (420) rotating about the tube second end (412), wherein the mobility from the pair of wheels (430) allows for fluid navigation of the system (999), wherein the handle bottom end (124) is fluidly disposed on the handle top end (123), wherein the blade-angle adjustment mechanism (200) is disposed in between the second body support (116) and the body bottom end (114), wherein the blade-angle adjustment mechanism (200) is sandwiched between a first body cover plate (510) and a second body cover plate (520), wherein the first body cover plate (510) and second body cover plate (520) are disposed on the body section (110) from the second body support (116) to the body bottom end (114), wherein the shovel blade assembly (300) is pivotally connected to the blade-angle adjustment mechanism (200) via the blade arm hub (320) interfacing with the hinge hole (240), wherein the blade arm clip (330) secures the arm (230) when the pair of blades (310) are in-line with each other, wherein an angle adjustment shaft (600) comprises a shaft first end (610) and a shaft second end (620), wherein the shaft first end (610) is disposed through the first body support (115) and the second body support (116) to key into the pinion (220), wherein the shaft second end (620) is secured to the first body support (115) via a pair of shaft clips (630), wherein removing the shaft second end (620) from the pair of shaft clips (630) and turning the shaft second end (620) activates the pinion (220), thus changing an angle between the pair of blades (310) of the shovel blade assembly (300) and allowing for more than six configurations of the system (999), wherein a tube housing (530) is centrally disposed on the second body cover plate (520), wherein the tube first end (411) inserts through and secures to the tube housing (530) such that the pair of wheels (430) contact the ground, wherein the angle of the system (999) relative to the ground is adjustable via adjusting the extent to which the tube first end (411) is secured to the tube housing (530), wherein the tube first end (411) can be swiveled 180 degrees to store the pair of wheels (430) in between the first body support (115) and second body support (116).

2. An adjustable snow shovel system (999) for facilitating effective removal of snow, comprising:

a rectangular-tubular frame (100) having a body section (110) and a handle section (120), the handle section (120) having a V-shaped outline, wherein a valley of the handle section (120) defines a rest surface (125) on which users can push the system (999) with body weight, wherein the handle section (120) comprises a handle top end (123) and a handle bottom end (124), wherein a first handle bar (126) and a second handle bar (127) are disposed from the handle bottom end (124) to the handle top end (123), wherein pushing the handle top end (123) with the first handle bar (126) or second handle bar (127) allows for fluid steering of the system (999), the body section (110) having a trapezoidal-shaped outline, wherein the body section (110) comprises a body top end (113) and a body bottom end (114), a blade-angle adjustment mechanism (200) having a pair of racks (210) and a pinion (220), wherein the pair of racks (210) each has a rack first end (211) and a rack second end (212), wherein a pair of arms (230) each comprises an arm first end (231) and an arm second end (232), wherein the arm second end (232) has a hinge hole (240), wherein the arm first end (231) is disposed on the rack second end (212), a shovel blade assembly (300) having a pair of blades (310), wherein each blade (310) has a blade arm hinge (360), wherein each blade (310) has a blade top end (340) and a blade bottom end (350) both adapted to shovel snow, wherein the pair of blades (310) are pivotally connected via the hinge (360), wherein a V-shaped shovel nose (370) covers and protects the hinge (360), wherein the shovel nose (370) prevents snow from impeding the system (999)'s (100) mobility, a truck assembly (400) having a goose neck-shaped wheel support tube (410), a spindle (420), and a pair of wheels (430), wherein the wheel support tube (410) comprises a tube first end (411) and a tube second end (412), wherein the spindle (420) is disposed on the tube second end (412), wherein the pair of wheels (430) are disposed on the spindle (420), wherein the pair of wheels (430) can swivel 360 degrees via the spindle (420) rotating about the tube second end (412), wherein the mobility from the pair of wheels (430) allows for fluid navigation of the system (999), wherein the handle bottom end (124) is fluidly disposed on the handle top end (123), wherein the blade-angle adjustment mechanism (200) is disposed at the body bottom end (114), wherein the shovel blade assembly (300) is pivotally connected to the blade-angle adjustment mechanism (200) via the blade arm hub (320) interfacing with the hinge hole (240), wherein an angle adjustment shaft (600) comprises a shaft first end (610) and a shaft second end (620), wherein the shaft first end (610) keys into the pinion (220), wherein turning the shaft second end (620) activates the pinion (220), thus changing an angle between the pair of blades (310) of the shovel blade assembly (300) and allowing for more than six configurations of the system (999), wherein a tube housing (530) is centrally disposed on the body section (110), wherein the tube first end (411) inserts through and secures to the tube housing (530) such that the pair of wheels (430) contact the ground, wherein the tube first end (411) can be swiveled to store the pair of wheels (430).

3. An adjustable snow shovel system (999) for facilitating effective removal of snow, comprising:

a rectangular-tubular frame (100) having a body section (110) and a handle section (120), the handle section (120) having a V-shaped outline, wherein the handle section (120) comprises a handle top end (123) and a handle bottom end (124), wherein a first handle bar (126) and a second handle bar (127) are disposed from the handle bottom end (124) to the handle top end (123), the body section (110) having a trapezoidal-shaped outline, wherein the body section (110) comprises a body top end (113) and a body bottom end (114), a blade-angle adjustment mechanism (200) having a pair of racks (210) and a pinion (220), wherein the pair of racks (210) each has a rack first end (211) and a rack second end (212), wherein a pair of arms (230) each comprises an arm first end (231) and an arm second end (232), wherein the arm second end (232) has a hinge hole (240), wherein the arm first end (231) is disposed on the rack second end (212), a shovel blade assembly (300) having a pair of blades (310), wherein each blade (310) has a blade arm hinge (360), wherein each blade (310) has a blade top end (340) and a blade bottom end (350), wherein the pair of blades (310) are pivotally connected via the hinge (360), wherein a V-shaped shovel nose (370) covers the hinge (360), a truck assembly (400) having a goose neck-shaped wheel support tube (410), a spindle (420), and a pair of wheels (430), wherein the wheel support tube (410) comprises a tube first end (411) and a tube second end (412), wherein the spindle (420) is disposed on the tube second end (412), wherein the pair of wheels (430) are disposed on the spindle (420), wherein the handle bottom end (124) is fluidly disposed on the handle top end (123), wherein the blade-angle adjustment mechanism (200) is disposed at the body bottom end (114), wherein the shovel blade assembly (300) is pivotally connected to the blade-angle adjustment mechanism (200) via a blade arm hub (320) interfacing with the hinge hole (240), wherein an angle adjustment shaft (600) comprises a shaft first end (610) and a shaft second end (620), wherein the shaft first end (610) keys into the pinion (220), wherein a tube housing (530) is centrally disposed on the body section (110), wherein the tube first end (411) inserts through and secures to the tube housing (530) such that the pair of wheels (430) contact the ground.

4. The system (999) of claim 3, wherein a valley of the handle section (120) defines a rest surface (125) on which users can push the system (999) with body weight.

5. The system (999) of claim 3, wherein pushing the handle top end (123) with the first handle bar (126) or the second handle bar (127) allows for fluid steering of the system (999).

6. The system (999) of claim 3, wherein each blade (310) has the blade top end (340) and the blade bottom end (350) both adapted to shovel snow.

7. The system (999) of claim 3, wherein the shovel nose (370) protects the hinge (360) and prevents snow from impeding the system (999)'s mobility.

8. The system (999) of claim 3, wherein the pair of wheels (430) can swivel 360 degrees via the spindle (420) rotating about the tube second end (412), wherein the mobility from the pair of wheels (430) allows for fluid navigation of the system (999).

9. The system (999) of claim 3, wherein turning the shaft second end (620) activates the pinion (220), thus changing an angle between the pair of blades (310) of the shovel blade assembly (300) and allowing for more than six configurations of the system (999).

10. The system (999) of claim 3, wherein the tube first end (411) can be swiveled to store the pair of wheels (430).

* * * * *